US009996989B2

(12) United States Patent
Abuelsaad et al.

(10) Patent No.: US 9,996,989 B2
(45) Date of Patent: Jun. 12, 2018

(54) EVENT TRACKING FOR VEHICLES

(71) Applicant: INTERNATIONAL BUSINESS MACHINES CORPORATION, Armonk, NY (US)

(72) Inventors: Tamer E. Abuelsaad, Somers, NY (US); Gregory J. Boss, Saginaw, MI (US); John E. Moore, Jr., Brownsburg, IN (US); Randy A. Rendahl, Raleigh, NC (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days. days.

(21) Appl. No.: 15/233,242

(22) Filed: Aug. 10, 2016

(65) Prior Publication Data

US 2018/0047221 A1 Feb. 15, 2018

(51) Int. Cl.
*G07C 5/00* (2006.01)
*G07C 5/08* (2006.01)

(52) U.S. Cl.
CPC ..... *G07C 5/0808* (2013.01); *G07C 5/0841* (2013.01)

(58) Field of Classification Search
CPC .. G07C 5/0808; G07C 5/0841; B60R 16/0232
USPC ..... 701/29; 340/989
See application file for complete search history.

(56) References Cited

U.S. PATENT DOCUMENTS 8,589,015 B2 11/2013 Willis et al.
2006/0288968 A1* 12/2006 Damian ..... F01P 11/14 123/41.15
2012/0153972 A1* 6/2012 Stockschlager ..... E05F 15/46 324/672
2012/0188105 A1* 7/2012 Alkhalaf ..... B60R 16/0232 340/989
2013/0268155 A1 10/2013 Mian et al.
2015/0035665 A1 2/2015 Plante et al.
2015/0105934 A1 4/2015 Palmer et al.
2015/0167826 A1* 6/2015 Farges ..... F16H 61/36 74/473.15
2015/0228129 A1* 8/2015 Cox ..... G07C 5/0808 701/29.1

FOREIGN PATENT DOCUMENTS

WO 2014016307 A1 1/2014
WO WO 2014089333 A1 * 6/2014 ..... B29C 44/1271

OTHER PUBLICATIONS

Jeong et al., "Detection of Lateral Hazardous Driving Events using In-vehicle Gyro Sensor Data," KSCE Journal of Civil Engineering, vol. 17, No. 6, 2012 (10 pages).

* cited by examiner

*Primary Examiner* — Marthe Y Marc-Coleman
(74) *Attorney, Agent, or Firm* — Griffiths & Seaton PLLC

(57) ABSTRACT

Embodiments for tracking vehicle events by capturing data from a vehicle component by a processor. Sensory instrumentation associated with the vehicle component is initialized to provide data to a repository when one of the vehicle events occurs. The data in the repository is analyzed to extrapolate the vehicle event to determine a condition of the vehicle.

18 Claims, 6 Drawing Sheets

EVENT TRACKING FOR VEHICLES

BACKGROUND OF THE INVENTION

Field of the Invention

The present invention relates in general to computing systems, and more particularly to, various embodiments for tracking events occurring on a vehicle by a processor.

Description of the Related Art

In today's interconnected and complex society, computers and computer-driven equipment are more commonplace. Processing devices, with the advent and further miniaturization of integrated circuits, have made it possible to be integrated into a wide variety of personal, business, health, home, education, and other devices. Accordingly, the use of computers, network appliances, and similar data processing devices continue to proliferate throughout society.

SUMMARY OF THE INVENTION

Various embodiments for tracking vehicle events by capturing data from a vehicle component by a processor, are provided. In one embodiment, by way of example only, a method for tracking vehicle events by capturing data from a vehicle component, again by a processor, is provided. Sensory instrumentation associated with the vehicle component is initialized to provide data to a repository when one of the vehicle events occurs. The data in the repository is analyzed to extrapolate the vehicle event to determine a condition of the vehicle.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE DRAWINGS

Figure 1:
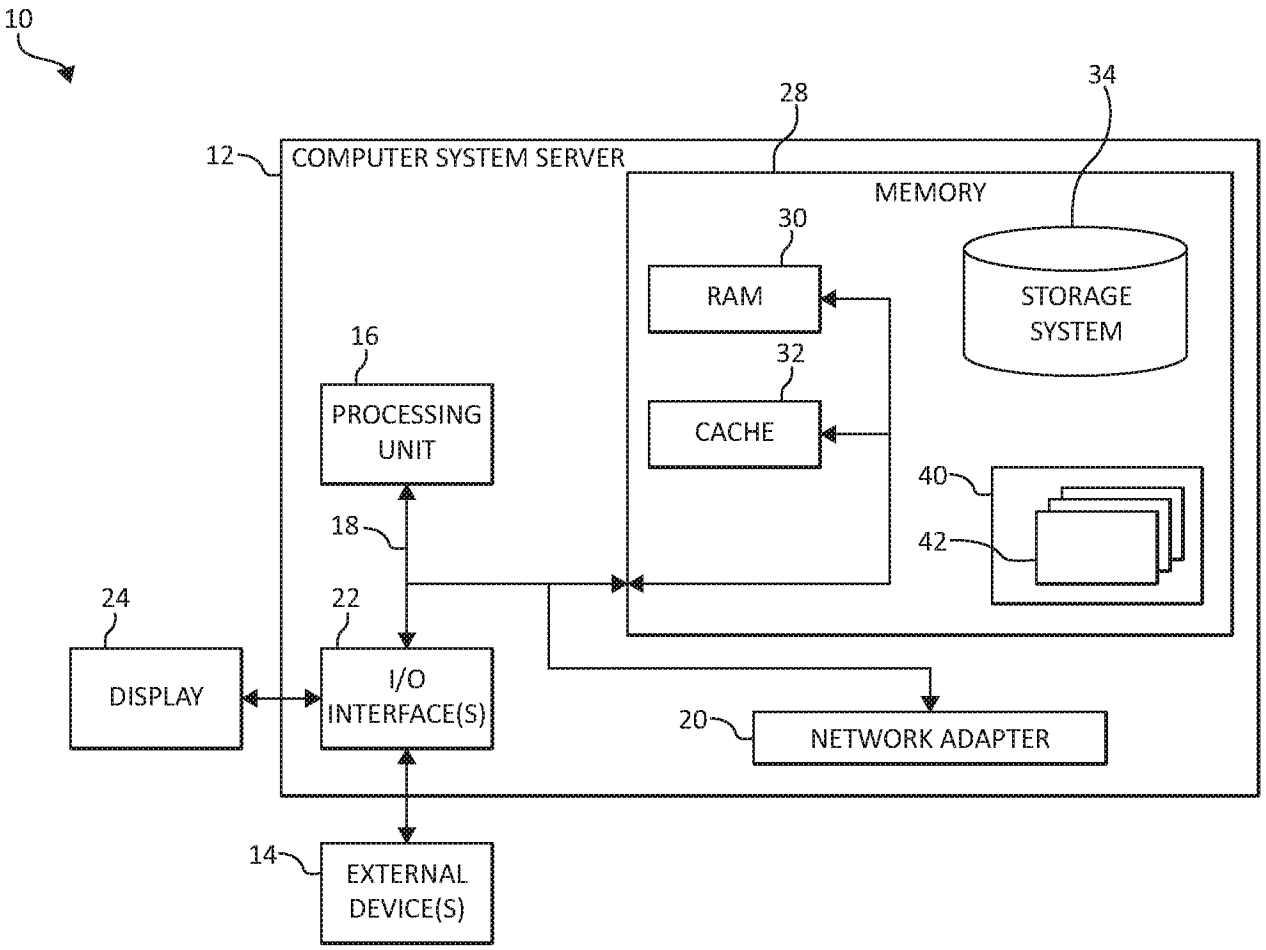
FIG. 1 is a block diagram depicting an exemplary computing node according to an embodiment of the present invention.

Traditionally, the value of a used vehicle is very difficult to ascertain due to the wide variety of factors that can affect the vehicle in terms of wear and tear, maintenance, accidents and other factors. Clear and complete vehicle histories may be challenging to determine and verify due to the indirect nature by which they may be discovered.

Conventional approaches for obtaining vehicle histories depend on self-reporting, and third party discovery methodologies related to billing information, accident reports, and other public information. A very well-known approach to obtaining a vehicle history involves a model that uses a variety of sources external to the vehicle, which provides information about the vehicle's history. Typically, the history report generated by this well-known approach includes public records information such as accident reports, and service information that was entered by a service technician into a shared database.

The service information performed on a particular vehicle that appears in the service history of this aforementioned well-known model may not be complete, as some service work may be performed outside of the database/reporting system, or an accident may not be reported to the police or to an insurance company, for example. An accurate and reliable method for obtaining a complete vehicle history for a particular vehicle remains a current need.

In view of the foregoing, a more valuable model than current approaches would provide a means by which the vehicle itself is able to provide enough information to describe its history to allow highlighting both the positive and negative aspects for the owner, prospective buyers, and interested parties such as mechanics.

The mechanisms of the illustrated embodiments leverage a variety of what will herein be referred to as "instrumentation" and/or other sensor, data-collection devices that are installed in electrical, electromechanical, electromagnetic, signal, or other communication with a particular vehicle component, such as vehicle parts. The instrumentation is used to monitor the particular vehicle component for a change in orientation, construction, position, or other difference as observed from a known origin. If a change is detected, the instrumentation and other sensory devices then capture data from the vehicle component, which is supplied to a data repository.

In conjunction with the data captured from a "vehicle event" triggering the detected change in the vehicle component, additional data, termed herein as "context data" may also be recorded. This context data may include such information as will be further described as whether the vehicle was moving, whether the engine was running, the location of the vehicle when the change was detected, and a wide variety of additional possible information, as one of ordinary skill in the art will appreciate.

The captured data from the instrument component, along with the context data may then be stored in the repository as an event in the vehicle's official historical record. At a subsequent time, for example, an analysis of the vehicle's historical record may then take place to determine, according to a particular situation, the current health of the vehicle, condition of the vehicle, or even the value of the vehicle. The mechanisms of the illustrated embodiments provide key advantages of enabling the compiling of a complete, accurate, and reliable vehicle history. Such a compilation would be useful to a variety of interested persons, such as owners (who, for example, are curious to know if a particular service has been performed per a recall), prospective buyers (who would be interested to know, for example, if the vehicle is accident free), and service technicians (who would be interested to know, for example, if an important component had been tampered with by an unauthorized person). Additional aspects of the present invention and attendant benefits will be further described, following.

It is understood in advance that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g. networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure comprising a network of interconnected nodes.

Referring now to FIG. 1, a schematic of an example of a cloud computing node is shown. Cloud computing node 10 is only one example of a suitable cloud computing node and is not intended to suggest any limitation as to the scope of use or functionality of embodiments of the invention described herein. As will be described, functional components of node 10 may even be miniaturized to the extent that they are integrated into wearable components to accomplish various purposes of the illustrated embodiments, such as into headgear, glasses, lenses, contacts, or other wearable components. Cloud computing node 10 is capable of being implemented and/or performing any of the functionality set forth hereinabove.

In cloud computing node 10 there is a computer system/server 12, which is operational with numerous other general purpose or special purpose computing system environments or configurations. Examples of well-known computing systems, environments, and/or configurations that may be suitable for use with computer system/server 12 include, but are not limited to, personal computer systems, server computer systems, thin clients, thick clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 12 may be described in the general context of computer system-executable instructions, such as program modules, being executed by a computer system. Generally, program modules may include routines, programs, objects, components, logic, data structures, and so on that perform particular tasks or implement particular abstract data types. Computer system/server 12 may be practiced in distributed cloud computing environments where tasks are performed by remote processing devices that are linked through a communications network. In a distributed cloud computing environment, program modules may be located in both local and remote computer system storage media including memory storage devices.

As shown in FIG. 1, computer system/server 12 in cloud computing node 10 is shown in the form of a general-purpose computing device. The components of computer system/server 12 may include, but are not limited to, one or more processors or processing units 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system/server 12 typically includes a variety of computer system readable media. Such media may be any available media that is accessible by computer system/server 12, and it includes both volatile and non-volatile media, removable and non-removable media.

System memory 28 can include computer system readable media in the form of volatile memory, such as random access memory (RAM) 30 and/or cache memory 32. Computer system/server 12 may further include other removable/non-removable, volatile/non-volatile computer system storage media. By way of example only, storage system 34 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, system memory 28 may include at least one program product having a set (e.g., at least one) of program modules that are configured to carry out the functions of embodiments of the invention.

Program/utility 40, having a set (at least one) of program modules 42, may be stored in system memory 28 by way of example, and not limitation, as well as an operating system, one or more application programs, other program modules, and program data. Each of the operating system, one or more application programs, other program modules, and program data or some combination thereof, may include an implementation of a networking environment. Program modules 42 generally carry out the functions and/or methodologies of embodiments of the invention as described herein.

Computer system/server 12 may also communicate with one or more external devices 14 such as a keyboard, a pointing device, a display 24, etc.; one or more devices that enable a user to interact with computer system/server 12; and/or any devices (e.g., network card, modem, etc.) that enable computer system/server 12 to communicate with one or more other computing devices. Such communication can occur via Input/Output (I/O) interfaces 22. Still yet, computer system/server 12 can communicate with one or more networks such as a local area network (LAN), a general wide area network (WAN), and/or a public network (e.g., the Internet) via network adapter 20. As depicted, network adapter 20 communicates with the other components of computer system/server 12 via bus 18. It should be understood that although not shown, other hardware and/or software components could be used in conjunction with computer system/server 12. Examples, include, but are not limited to: microcode, device drivers, redundant processing units, external disk drive arrays, RAID systems, tape drives, and data archival storage systems, etc.

In the context of the present invention, and as one of skill in the art will appreciate, various components depicted in FIG. 1 may be integrated into wearable components. For example, some of the processing and data storage capabilities associated with mechanisms of the illustrated embodiments may take place locally via local processing components, while the same components are connected via a network to remotely located, distributed computing data processing and storage components to accomplish various purposes of the present invention. Again, as will be appreciated by one of ordinary skill in the art, the present illustration is intended to convey only a subset of what may be an entire connected network of distributed computing components that accomplish various inventive aspects collectively.

Figure 2:
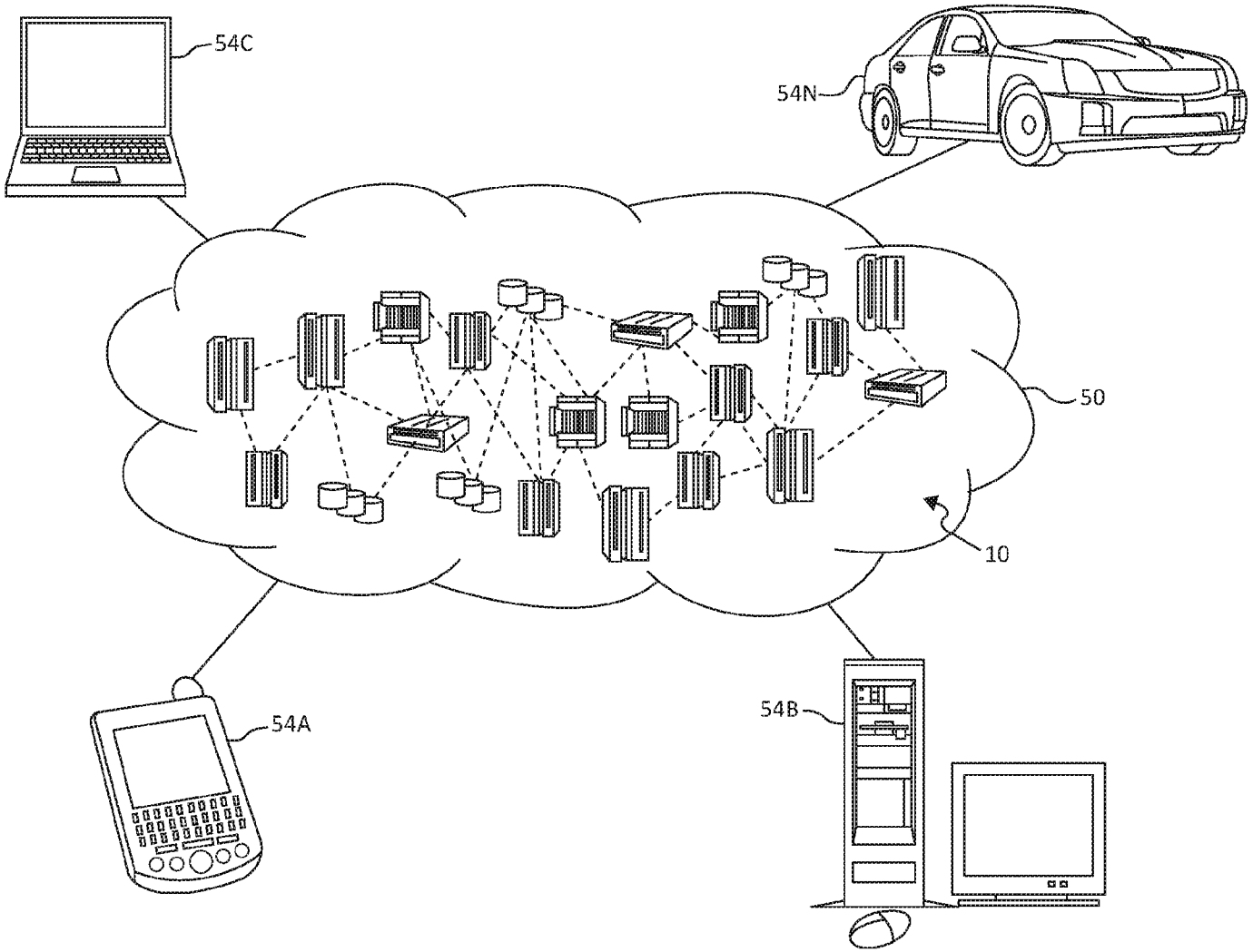
FIG. 2 is an additional block diagram depicting an exemplary cloud computing environment according to an embodiment of the present invention.

Referring now to FIG. 2, illustrative cloud computing environment 50 is depicted. As shown, cloud computing environment 50 comprises one or more cloud computing nodes 10 with which local computing devices used by cloud consumers, such as, for example, smartphone or cellular telephone 54A, desktop computer 54B, laptop computer 54C, and/or in the context of the present invention, vehicle 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 2 are intended to be illustrative only and that computing nodes 10 and cloud computing environment 50 can communicate with any type of computerized device over any type of network and/or network addressable connection (e.g., using a web browser).

Figure 3:
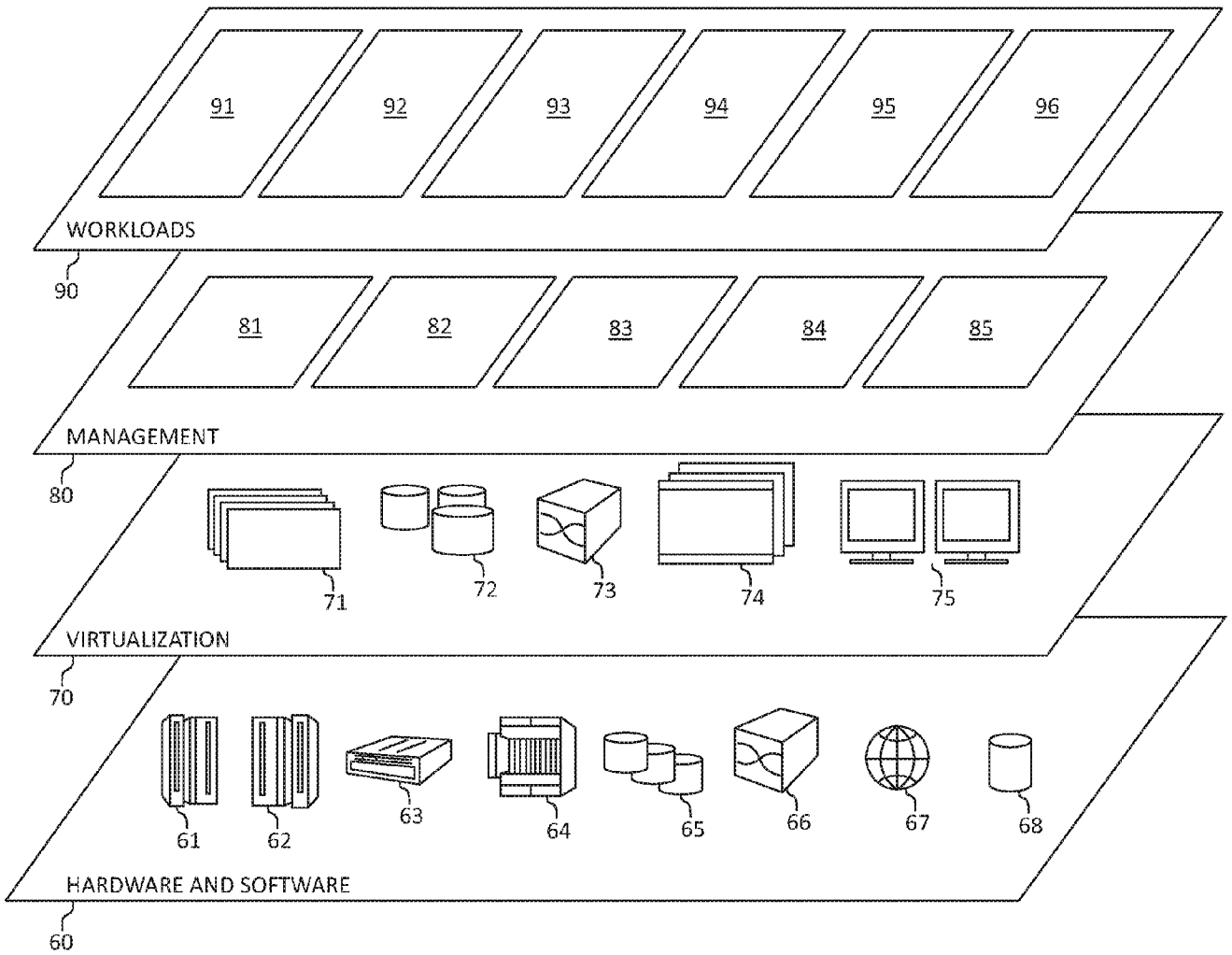
FIG. 3 is an additional block diagram depicting abstraction model layers according to an embodiment of the present invention.

Referring now to FIG. 3, a set of functional abstraction layers provided by cloud computing environment 50 (FIG. 2) is shown. It should be understood in advance that the components, layers, and functions shown in FIG. 3 are intended to be illustrative only and embodiments of the invention are not limited thereto. As depicted, the following layers and corresponding functions are provided:

Hardware and software layer 60 includes hardware and software components. Examples of hardware components include: mainframes 61; RISC (Reduced Instruction Set Computer) architecture based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provides cost tracking as resources are utilized within the cloud computing environment, and billing or invoicing for consumption of these resources. In one example, these resources may comprise application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provides pre-arrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and, in the context of the illustrated embodiments of the present invention, various vehicle event data processing workloads and functions 96. In addition, vehicle workloads and functions 96 may include such operations as data analysis (including data collection and processing from various sensors) and data sharing workloads (such as sharing visual information over a network to another user). One of ordinary skill in the art will appreciate that the vehicle event data processing workloads and functions 96 may also work in conjunction with other portions of the various abstractions layers, such as those in hardware and software 60, virtualization 70, management 80, and other workloads 90 (such as data analytics processing 94, for example) to accomplish the various purposes of the illustrated embodiments of the present invention.

As previously mentioned, the mechanisms of the illustrated embodiments provide novel approaches for the initialization, monitoring, collection of data, coordination of context data, storage, and analysis of information relating to various events in a vehicle historical record. A typical vehicle includes multiple components (e.g., parts) of various sizes. In order to identify a change, such as a removal, of any one of these parts, instrumentation associated with the components is necessary. The instrumentation records any changes that take place. As will be further described, the mechanisms of the illustrated embodiments rely on various instrumentation and data recording to achieve intelligence from this data, and provide controlled, meaningful analysis to a prospective buyer, vehicle owner, and others.

In one embodiment, the functionality of the overall invention is related to the set of instruments provided within the vehicle. The data is gathered and stored in a repository that may be termed a "vehicle history module." This module may be configured, in one embodiment, to possess read-only access outside the sensor data collection mechanisms of the present invention. Instrumentation may be associated with some vital components, or with each vehicle component, as dependent on the particular embodiment.

Figure 4:
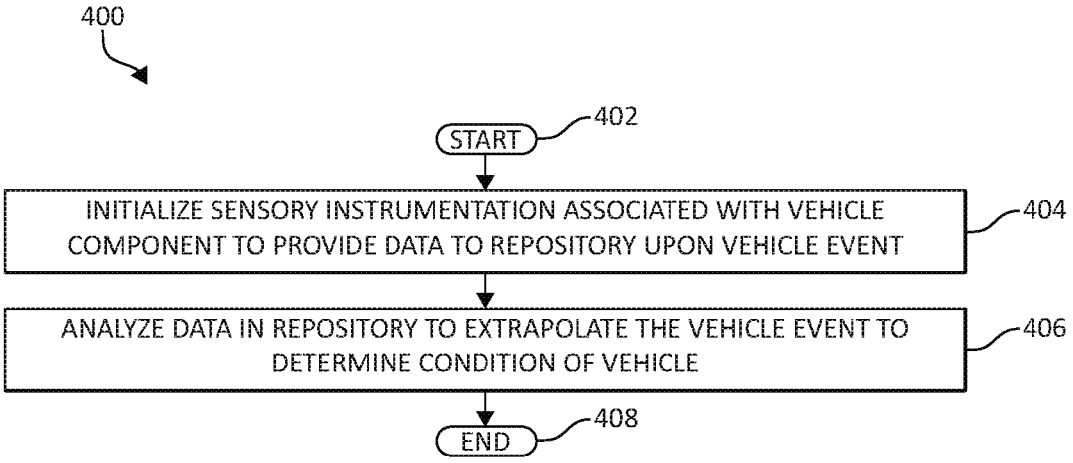
FIG. 4 is a flowchart diagram depicting an exemplary method for tracking vehicle events by capturing data, in which various aspects of the present invention may be implemented.

Turning now to FIG. 4, an exemplary method 400 for tracking events in a vehicle for capturing data by a processor is depicted, in which various aspects of the illustrated embodiments may be implemented. Method 400 begins (step 402) with the initialization of sensory instrumentation associated with a vehicle component to provide data to a repository upon a vehicle event (e.g., a change in the component's position, orientation, removal, etc.) (step 404). In a subsequent step 406, the data from the repository is analyzed to extrapolate the vehicle event to determine the condition of the vehicle. The method 400 then ends (step 408).

As previously mentioned, instrumented parts, when acted upon, will generate data and may then broadcast the data to the vehicle history module. In one embodiment, the data broadcast may occur through a wired vehicle communications network apparent to one of ordinary skill in the art. In alternative embodiments, the broadcast may occur through wireless communications protocols.

The vehicle history module may record a variety of data and the aforementioned context data. Examples of the context data that may be recorded in conjunction with data captured from a vehicle component may include, but as one of ordinary skill in the art will appreciate, are not limited to, the following: (1) vehicle location via global positioning system (GPS) or equivalent, (2) engine revolutions-per-minute (RPM), (3) vehicle speed, (4) whether the key is in the ignition or whether the ignition is on/off, (5) the vehicle altitude, (6) the status of the vehicle's shocks (e.g., fully extended shocks imply the vehicle is on a lift above the ground), and (7) status of all doors, trunk and hood, including the time the door, trunk or hood remained open. The context data retrieved with the instrumentation-collected data from various components may be retrieved from a variety of sources, including existing vehicle systems, external data sources (e.g., cloud-based weather service), and other data sources.

While specific instrumentation may be associated with every vehicle component such that movement, change in orientation, direction, removal, replacement, or other change in status of the vehicle component may be recorded, the present description will introduce four possible embodiments of vehicle instrumentation that accomplish various aspects of the present invention as follows.

A first exemplary embodiment involves the configuration and initialization of vehicle fastener devices (such as a screw) using directional radio frequency identification (RFID) functionality as instrumentation. In such an embodiment, each monitored fastener may have an associated RFID tag attached to a portion of the fastener. The RFID tag uniquely identifies the fastener. The RFID identification includes, among other information, the type of fastener. For example, in a threaded screw, the type of screw gives an indication to the number of threads that the screw contains.

Continuing the example of the threaded screw, each 360 degree turn of the screw may be counted as one thread on the threaded screw. If, for example, a particular screw is supposed to contain 13 threads, and 13 turns are recorded, then it may be assumed that the particular screw was removed. Conversely, if the turn direction is determined to be in the opposite direction, it may be assumed that the threaded screw was affixed in position.

A second exemplary embodiment involves the configuration and initialization of metallic continuity sensors as instrumentation associated with a particular component. In this way, the electrical continuity between metal pieces may be monitored. If a screw were removed from a part, for example, the electrical continuity between the screw and the part would be disrupted. The disruption may then be communicated to the vehicle history module and recorded.

In a third exemplary embodiment, various sensors may be installed that are in communication with vehicle components that extend and retract. A sensor placed on a strut tower of the vehicle may determine if the vehicle has been fully extended, such as when the vehicle is undergoing maintenance on a lift. If, for example, all four wheels have been fully extended, and the vehicle speed gleaned from context data is determined to be zero, an assumption may be made that the vehicle has been lifted and possibly had maintenance performed. If, for example, a single wheel was lifted, one can infer that the work performed may relate to a brake inspection, tire change, or similar. Here again, the lifting data may be correlated with the additional context data from the tire pressure sensor in the appropriate wheel.

In a fourth exemplary embodiment, a linear hall effect sensor may be implemented as instrumentation to measure movement of magnetically charged fasteners, such as the head of a threaded screw. This instrumentation is generally cost effective, and may be used for components such as screws that turn or are removed without turning. Linear hall effect sensors may also operate on components made of various materials.

In the exemplary embodiment, each component (such as a screw head) is instrumented with magnetic material. The magnetic material is placed, for example, on just one sliver of the screw head (or near the top). A linear hall sensor is placed within proximity to the screw (for stronger magnets and stronger sensors, one sensor can monitor more than one screw). For threaded screws, as the screw is turned, the linear hall sensor will measure the magnetic strength. Each time the screw is turned and the magnetic strip aligns with the hall sensor a count of one turn is recorded. The strength of the magnetic field will grow weaker as the screw is being removed from its position and will grow stronger as it is getting affixed in its position. Complete removal of the screw will show on the linear hall sensor as there is absence of a previously present magnetic field.

Figure 5B:
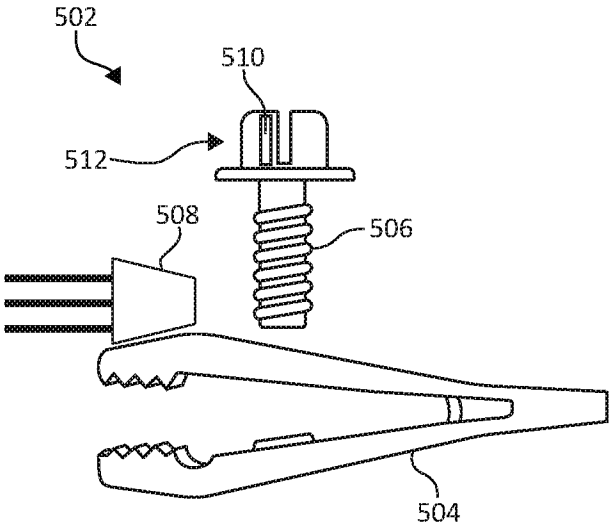
FIG. 5B is an additional block diagram depicting various user hardware components functioning in accordance with aspects of the present invention.
Figure 5A:
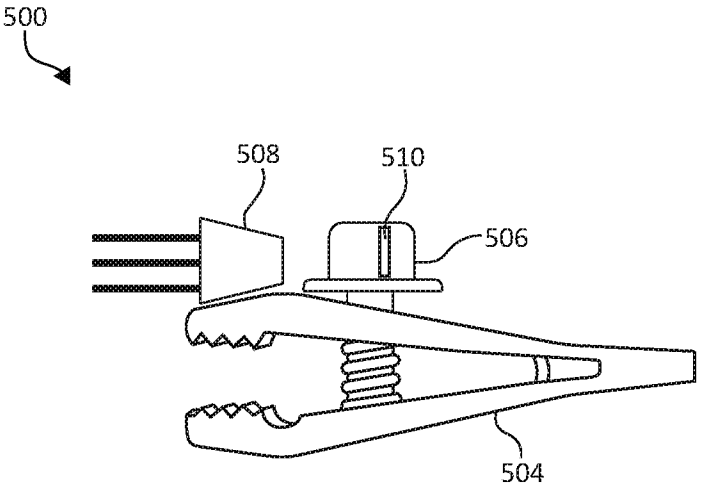
FIG. 5A is an additional block diagram depicting various user hardware components functioning in accordance with aspects of the present invention.

FIGS. 5A and 5B, following, illustrate in block diagram form, the linear hall effect instrumentation embodiment. First, in FIG. 5A, an illustration 500 depicts a vehicle component 504 having a screw 506 affixed in its correct position. The linear hall effect sensor 508 is configured in electromagnetic communication with the magnetic strip 510, which is deposited on one portion of the screw 506 head as shown.

In the illustration 502 in FIG. 5B, following, the screw 506 has been partially removed 512 from the vehicle component 504 as shown, and the linear hall effect sensor 508 has determined that the magnetic field associated with the magnetic strip 510 has changed (decreased in intensity, for example, or is now absent).

Figure 6:
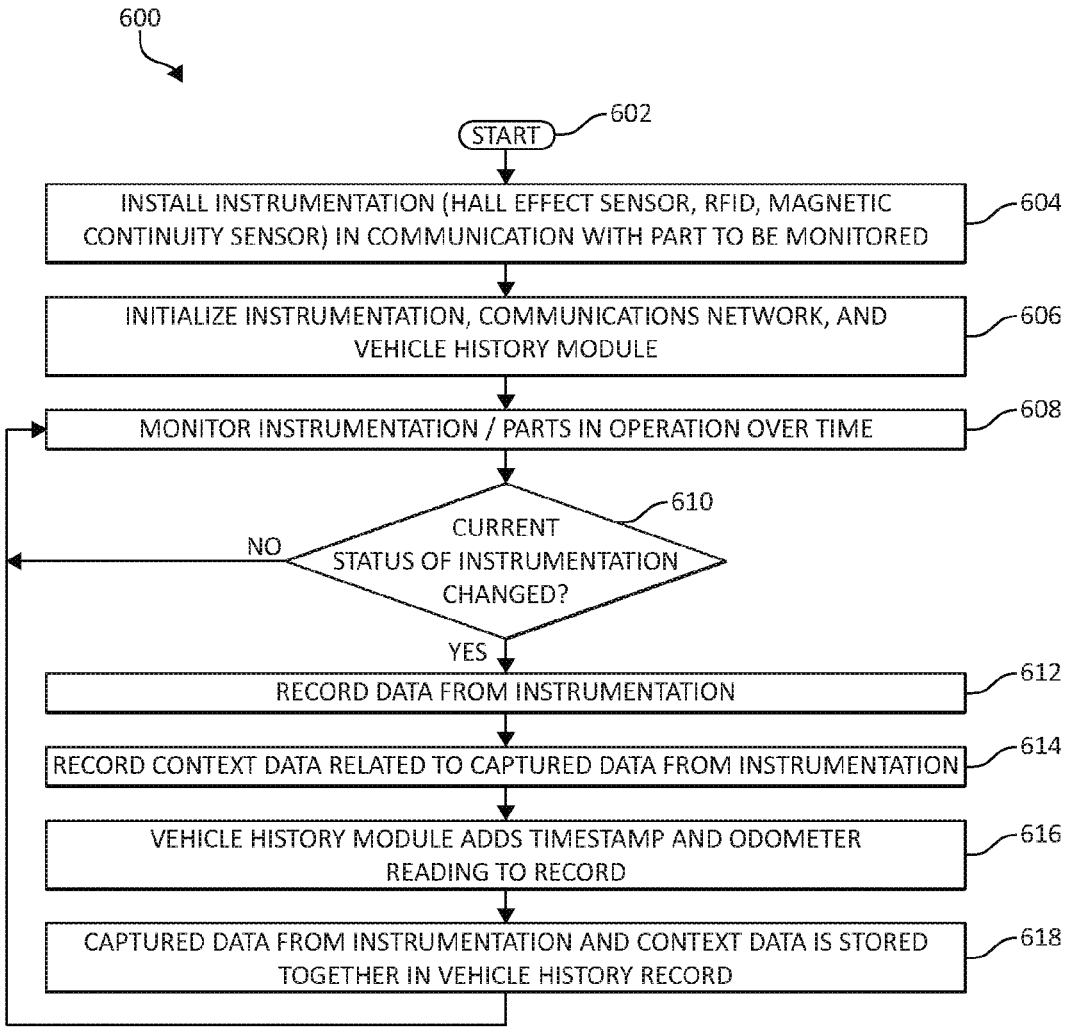
FIG. 6 is an additional flowchart diagram depicting an additional exemplary method for tracking vehicle events by capturing data, again in which various aspects of the present invention may be implemented.

FIG. 6, following, is an additional flowchart diagram of an exemplary method 600 for tracking vehicle events in accordance with various aspects of the illustrated embodiments. Method 600 begins (step 602) with the installation of appropriate instrumentation (e.g., the previously mentioned RFID tags, hall effect sensors, electrical continuity sensor) in communication with the component(s) being monitored (step 604). In one embodiment, the selection of the instrumentation for a particular vehicle may be performed in accordance with predetermined levels of importance of certain components. For example, a particular component in the vehicle's fuel system may be determined to be important enough to warrant being instrumented and monitored by the system. As one of ordinary skill in the art will appreciate, the selection of various instrumentation for a vehicle may depend on a variety of circumstances, such as resource constraints, importance to the manufacturer, buyer, or owner, or other factors.

Once the various instrumentation is installed, the instruments are initialized, an internal communications network (e.g., wired or wireless) is initialized, and the vehicle history module is initialized for operation (step 606). The instruments and associated vehicle components are then monitored over time to detect changes (step 608).

Once a status change is detected in decision step 610, the appropriate data is captured from the component/instrumentation (step 612), along with appropriate context data related to the vehicle event (step 614). The vehicle history module then adds timestamp and odometer information to the record in step 616, and the captured data from the instrumentation and context data is stored together in a vehicle history record (step 618). The method 600 then moves to step 608 to continue to monitor instrumentation over time as the vehicle's historical information is built.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowcharts and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowcharts and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowcharts and/or block diagram block or blocks.

The flowcharts and block diagrams in the Figures illustrate the architecture, functionality, and operation of possible implementations of systems, methods, and computer program products according to various embodiments of the present invention. In this regard, each block in the flowcharts or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustrations, and combinations of blocks in the block diagrams and/or flowchart illustrations, can be implemented by special purpose hardware-based systems that perform the specified functions or acts or carry out combinations of special purpose hardware and computer instructions.

The invention claimed is:

1. A method for tracking vehicle events by capturing data from a vehicle component, comprising:

initializing, by a processor housed within a vehicle, sensory instrumentation associated with the vehicle component to provide data to a repository when one of the vehicle events occurs; wherein initializing the sensory instrumentation further includes initializing a linear hall effect sensor in electromagnetic communication with a fastening structure comprising a screw or bolt to determine if, during the one of the vehicle events, the fastening structure was turned or removed; and analyzing the data in the repository to extrapolate the one of the vehicle events to determine a condition of the vehicle.

2. The method of claim 1, wherein initializing the sensory instrumentation further includes initializing a direction Radio Frequency Identification (RFID) tag attached to a portion of a fastening structure to determine if, during the one of the vehicle events, the fastening structure was turned or removed.

3. The method of claim 1, wherein initializing the sensory instrumentation further includes initializing a metallic continuity detector in conjunction with the vehicle component to determine if, during the one of the vehicle events, the vehicle component loses metallic continuity with another vehicle component.

4. The method of claim 1, further including monitoring the sensory instrumentation over time to build a history of vehicle events used to at least partially determine the condition of the vehicle.

5. The method of claim 1, further including recording, in conjunction with data captured from the sensory instrumentation, context data to assist in determining the condition of the vehicle.

6. The method of claim 1, further including initializing the sensory instrumentation for those fastening structures having a predetermined importance in a construction of the vehicle.

7. A system for tracking vehicle events by capturing data from a vehicle component, comprising:

a processor, that:

initializes sensory instrumentation associated with the vehicle component to provide data to a repository when one of the vehicle events occurs; wherein initializing the sensory instrumentation further includes initializing a linear hall effect sensor in electromagnetic communication with a fastening structure comprising a screw or bolt to determine if, during the one of the vehicle events, the fastening structure was turned or removed, and analyzes the data in the repository to extrapolate the one of the vehicle events to determine a condition of the vehicle.

8. The system of claim 7, wherein the processor, pursuant to initializing the sensory instrumentation, initializes a direction Radio Frequency Identification (RFID) tag attached to a portion of a fastening structure to determine if, during the one of the vehicle events, the fastening structure was turned or removed.

9. The system of claim 7, wherein the processor, pursuant to initializing the sensory instrumentation, initializes a metallic continuity detector in conjunction with the vehicle component to determine if, during the one of the vehicle events, the vehicle component loses metallic continuity with another vehicle component.

10. The system of claim 7, wherein the processor monitors the sensory instrumentation over time to build a history of vehicle events used to at least partially determine the condition of the vehicle.

11. The system of claim 7, wherein the processor records, in conjunction with data captured from the sensory instrumentation, context data to assist in determining the condition of the vehicle.

12. The system of claim 7, wherein the processor initializes the sensory instrumentation for those fastening structures having a predetermined importance in a construction of the vehicle.

13. A computer program product for tracking vehicle events by capturing data from a vehicle component by a processor, the computer program product comprising a non-transitory computer-readable storage medium having computer-readable program code portions stored therein, the computer-readable program code portions comprising:

an executable portion that initializes sensory instrumentation associated with the vehicle component to provide data to a repository when one of the vehicle events occurs; wherein initializing the sensory instrumentation further includes initializing a linear hall effect sensor in electromagnetic communication with a fastening structure comprising a screw or bolt to determine if, during the one of the vehicle events, the fastening structure was turned or removed; and an executable portion that analyzes the data in the repository to extrapolate the one of the vehicle events to determine a condition of the vehicle.

14. The computer program product of claim 13, further including an executable portion that, pursuant to initializing the sensory instrumentation, initializes a direction Radio Frequency Identification (RFID) tag attached to a portion of a fastening structure to determine if, during the one of the vehicle events, the fastening structure was turned or removed.

15. The computer program product of claim 13, further including an executable portion that, pursuant to initializing the sensory instrumentation, initializes a metallic continuity detector in conjunction with the vehicle component to determine if, during the one of the vehicle events, the vehicle component loses metallic continuity with another vehicle component.

16. The computer program product of claim 13, further including an executable portion that monitors the sensory instrumentation over time to build a history of vehicle events used to at least partially determine the condition of the vehicle.

17. The computer program product of claim 13, further including an executable portion that records, in conjunction with data captured from the sensory instrumentation, context data to assist in determining the condition of the vehicle.

18. The computer program product of claim 13, further including an executable portion that initializes the sensory instrumentation for those fastening structures having a predetermined importance in a construction of the vehicle.

* * * * *